United States Patent [19]

Landa

[11] Patent Number: 4,949,133

[45] Date of Patent: Aug. 14, 1990

[54] APPARATUS FOR CLEANING AND MOVING A PHOTORECEPTOR

[75] Inventor: Benzion Landa, Rehovot, Israel

[73] Assignee: Xerox Corporation, Stamford, Conn.

[21] Appl. No.: 271,830

[22] Filed: Nov. 16, 1988

[51] Int. Cl.[5] ..... G03G 21/00

[52] U.S. Cl. ..... 355/296; 15/256.5; 118/652

[58] Field of Search ..... 355/256, 296, 301, 303, 355/307; 15/256.5, 256.51, 256.52, 102; 118/652

[56] References Cited

U.S. PATENT DOCUMENTS

| | | | |
|---|---|---|---|
| 3,556,653 | 1/1971 | Kolibas | 355/309 X |
| 3,653,756 | 4/1972 | Mielnikowski, Jr. et al. | 355/210 |
| 3,687,107 | 8/1972 | Borelli et al. | 118/652 |
| 3,725,059 | 4/1973 | Komp | 355/307 X |
| 3,893,417 | 7/1975 | York | 355/259 X |
| 3,921,580 | 11/1975 | Kase | 355/257 X |
| 3,944,354 | 5/1976 | Benwood et al. | 355/200 |
| 3,945,079 | 3/1976 | Westberg | 15/102 X |
| 3,955,533 | 5/1976 | Smith et al. | 355/297 X |
| 4,021,113 | 5/1977 | Zindikus et al. | 355/297 |
| 4,126,101 | 11/1978 | Yamamoto | 118/652 X |
| 4,127,082 | 11/1978 | Kawabata | 118/652 |

OTHER PUBLICATIONS

IBM Technical Bulletin, vol. 16, No. 4, p. 1268, Published: 9/73, Authors: Bullock et al.

*Primary Examiner*—Fred L. Braun

*Attorney, Agent, or Firm*—H. Fleischer; J. E. Beck; R. Zibelli

[57] ABSTRACT

An electrophotographic printing machine in which extraneous liquid developer material on a photoconductive belt is substantially removed therefrom by a cleaning roller. A backup roller is rotatively coupled to the cleaning roller with the photoconductive belt being interposed therebetween. The rollers are pressed into contact with the photoconductive belt. Either the photoconductive belt or backup roller are moved with movement of one frictionally moving the other. In this way, the cleaning roller and the belt move with the extraneous liquid material being removed fom the belt.

6 Claims, 2 Drawing Sheets

APPARATUS FOR CLEANING AND MOVING A PHOTORECEPTOR

This invention relates generally to an electrophotographic printing machine, and more particularly concerns cleaning residual liquid developer material from a photoconductive member and moving the photoconductive member.

Generally, the process of electrophotographic printing includes charging a photoconductive member to a substantially uniform potential to sensitive the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed bringing a liquid developer material into contact therewith. The liquid developer material comprises a liquid carrier having a suspension of charged toner particles dispersed therein. The toner particles are deposited, in image configuration, on the photoconductive member. Thereafter, the developed image is transferred to a copy sheet. The developed image transferred to the cope sheet is subsequently permanently fused thereto. Invariably, some of the liquid carrier and toner particles remain on the photoconductive member. This residual liquid developer material is cleaned therefrom at a cleaning station.

Numerous techniques have been developed for cleaning residual liquid developer material from the photoconductive member. Frequently, a roller is positioned in contact with the photoconductive member. The roller moves in synchronism with the photoconductive member, i.e. the roller tangential velocity is approximately equal to the velocity of the photoconductive member. Generally, the cleaning roller and the photoconductive member are driven independently. This requires separate drive transmissions for the cleaning roller and the photoconductive member. Elimination of one of the drive transmissions would clearly reduce cost and complexity. Hereinbefore, various techniques have been devised for rotating rollers and moving belts. The following disclosures appear to be pertinent:

U.S. Pat. No. 3,556,653
Patentee: Kolibas
Issued: January 19, 1971
U.S. Pat. No. 3,653,756
Patentee: Mielnikowski, Jr. et al.
Issued: April 4, 1982
U.S. Pat. No. 3,893,417
Patentee: York
Issued: July 8, 1975
U.S. Pat. No. 3,921,580
Patentee: Kase
Issued: November 25, 1975
U.S. Pat. No. 3,944,354
Patentee: Benwood et al.
Issued: May 16, 1976
U.S. Pat. No. 3,955,533
Patentee Smith et al.
Issued: May 11, 1976
U.S. Pat. No. 4,021,113
Patentee: Zindikus et al.
Issued: May 3, 1977
IBM Technical Bulletin
Vol. 16, No.4, Page 1268
Published: September, 1973

-continued

Authors: Bullock et al.

The relevant portions of the foregoing disclosures may be briefly summarized as follows:

U.S. Pat. No. 3,556,653 describes a pair of squeegee rollers which remove excess carrier liquid from a liquid image transferred to a copy sheet. The copy sheet advances through the nip defined by the pair of rollers. One of these rollers has a frictional driving surface for moving the sheet, and the other has a hard smooth surface for contact with the imaged surface of the sheet so as to provide minimum disturbance of the image pigment.

U.S. Pat. No. 3,653,756 discloses an electrophotographic copying apparatus wherein a single drive synchronously operates a sequence of function stations during a copying procedure. The drive has a motor, an endless chain and a plurality of drive sprockets mounted on shafts.

U.S. Pat. No. 3,893,417 teaches an apparatus for developing electrostatic images. Guide rollers are provided which cooperate with development rollers to move a flexible image bearing member therebetween. A drive mechanism is provided to drive the rollers of the apparatus at an equal velocity. Subsequently, relative motion between rollers is prevented so that smearing of the toner images does not occur.

U.S. Pat. No. 3,921,580 discloses a method for the liquid development of electrostatic images upon a charge retentive surface. A squeegee roller is compressible against a second roller made of stainless steel. The squeegee may be powered by any number of drives. A V-shaped belt extends from the squeegee roller and passes over an idler puller to drive a development roller by means of a second V-shaped belt.

U.S. Pat. No. 3,944,354 describes a voltage measurement apparatus including a grounded roller with six electrometer probes positioned at equally spaced intervals about the outer periphery of the roller. Three probes are located at each end of the roller to allow side-to-side readings of a moving electrostatically charged photoconductive web. An insulated ring is secured around each end of the roller in a contacting relationship with the charged photoconductive web so as to provide a friction drive for the roller. The two rings also maintain the probes at a fixed distance from the web.

U.S. Pat. No. 3,955,533 discloses a squeegee roller biased against a photoconductive drum by weights or springs with a predetermined force. As the drum rotates, the squeegee roller is rotated and the excess developer liquid is squeezed out of the nip defined by the drum and roller to flow downwardly into a receptacle. A cleaning roll engages the squeegee roller and is rotated by a motor in a direction opposite to the direction of rotation of the squeegee roll. A blade contacts the cleaning roll and wipes excess liquid from the surface of the cleaning roll.

U.S. Pat. No. 4,021,113 describes a cleaning brush roller engaging a photoconductive drum upstream of a cleaning web. The brush roller rests against the photoconductive drum under the force of gravity or may be biased thereagainst by springs. The brush roller is frictionally rotated by the rotation of the photoconductive drum.

The IBM Technical Bulletin teaches a wiper cleaning roll which engages against a photoconductive drum. The wiper roll is cleaned by a scavenger roll. The wiper and scavenger rolls are driven simultaneously by a single motor and a belt and pulley system.

In accordance with one aspect of the present invention, there is provided an apparatus for removing extraneous liquid material from a moving belt. The apparatus includes a first roller for cleaning a substantial portion of the extraneous liquid material from the belt. A second roller is rotatively coupled to the first roller with the belt being interposed between the first roller and the second roller. Means are provided for pressing the first roller and the second roller into contact with the belt. Means move either the belt or the second roller with movement of one frictionally moving the other so that the first roller and the belt move with the extraneous liquid material being removed from the belt.

Pursuant to another aspect of the features of the present invention, there is provided an electrophotographic printing machine in which extraneous liquid developer material is removed from a photoconductive belt. The improvement includes a first roller for cleaning a substantial portion of the extraneous liquid material from the photoconductive belt. A second roller is rotatively coupled to the first roller with the photoconductive belt being interposed between the first roller and the second roller. Means are provided for pressing the first roller and the second roller into contact with the photoconductive belt. Means move either the photoconductive belt or the second roller with movement of one frictionally moving the other so that the first roller and the belt move with the extraneous liquid material being removed from the belt.

Other aspects of the present invention will become apparent as the following description proceeds and upon reference to the drawings, in which.

While the present invention will hereinafter be described in conjunction with a preferred embodiment thereof, it will be understood that it is not intended to limit the invention to this embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
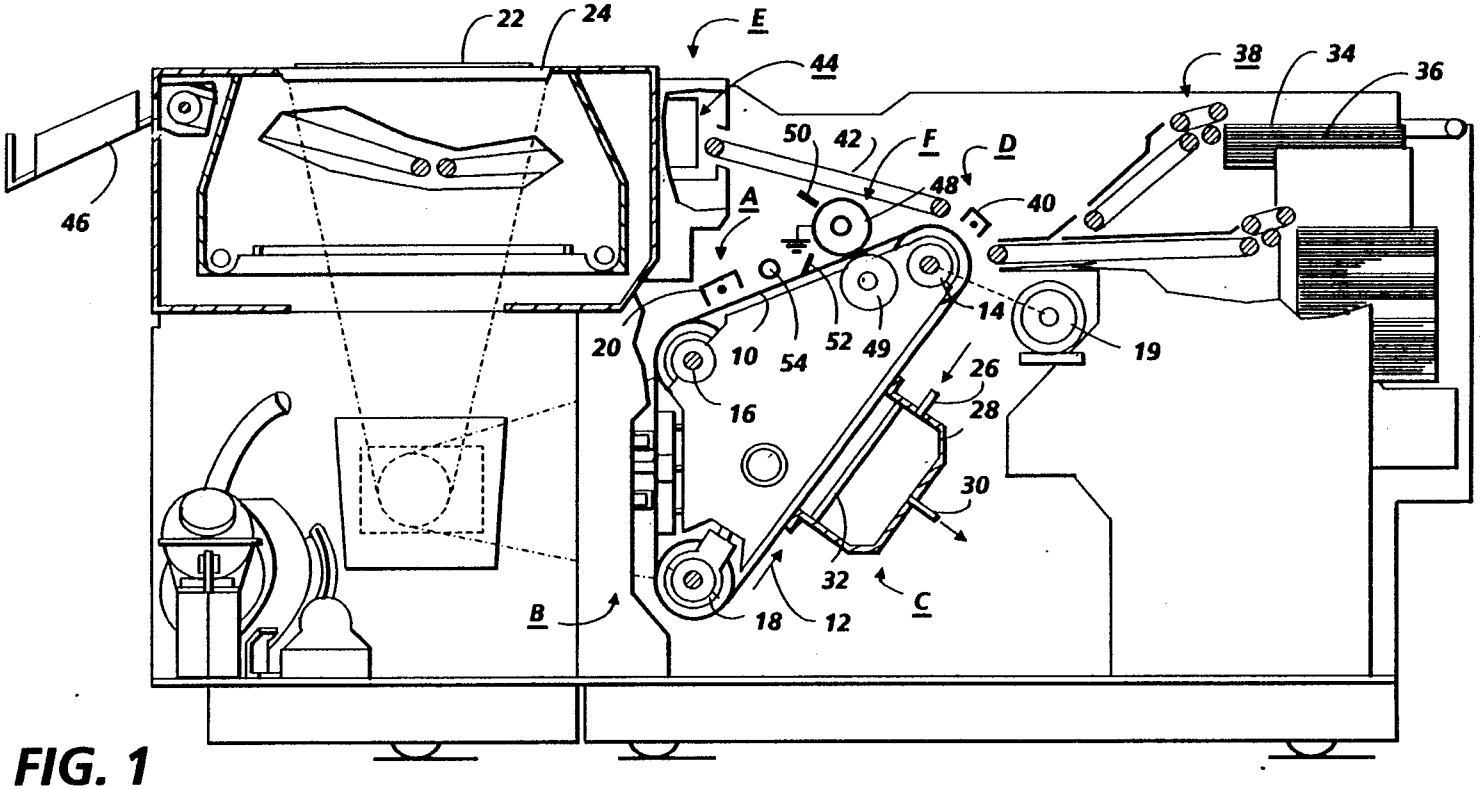
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor 19 associated with a drive, e.g. a belt and pulley drive, to move belt 10 in the direction of arrow 12.

Initially, a portion of belt 10 passes through charging station A. At charging station A, a corona generating device, indicated generally by the reference numeral 20, charges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto original document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a developing liquid comprising an insulating carrier liquid and toner particles, is circulated from any suitable source (not shown) through pipe 26 into development tray 28 from which it is withdrawn through pipe 30 for recirculation. Development electrode 32, which may be appropriately electrically biased, assists in developing the electrostatic latent image with the toner particles, i.e. the pigmented particles dispersed in the liquid carrier, as it passes in contact with the developing liquid. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Generally, the amount of liquid carrier on the photoconductive surface is too great. A roller (not shown) whose surface moves in a direction opposite to the direction of movement of the photoconductive surface, is spaced from the photoconductive surface and adapted to shear excessive liquid from the developed image without disturbing the image.

After development, belt 10 advances the developed image to transfer station D. At transfer station D, a sheet of support material 34, i.e. a copy sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. This attracts the developed image from the photoconductive surface to the copy sheet. After transfer, the copy sheet continues to move onto conveyor 42 which advances the sheet to fusing station E.

Fusing station E includes a radiant fuser indicated generally by the reference numeral 44. The fuser assembly vaporizes the liquid carrier from the copy sheet and permanently fuses the toner particles, in image configuration, thereto. After fusing, the copy sheet is advanced to catch tray 46 for subsequent removal from the printing machine by the operator.

Figure 2:
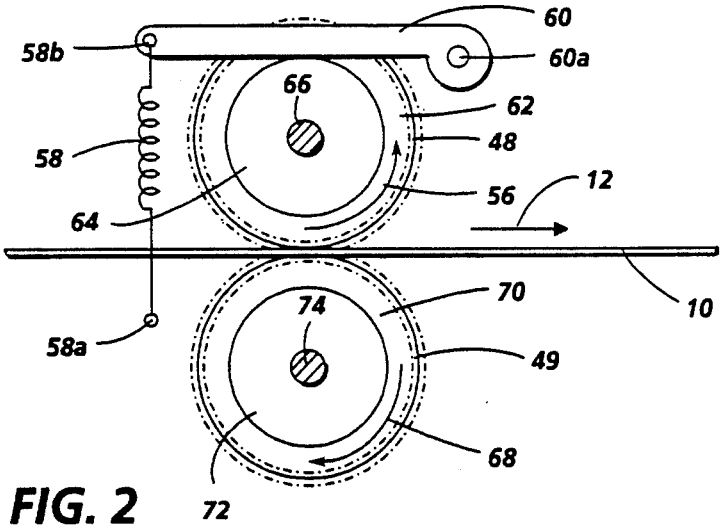
FIG. 2 is a schematic elevational view depicting the cleaning rollers operatively associated with the photoconductive belt of the FIG. 1 printing machine.
Figure 3:
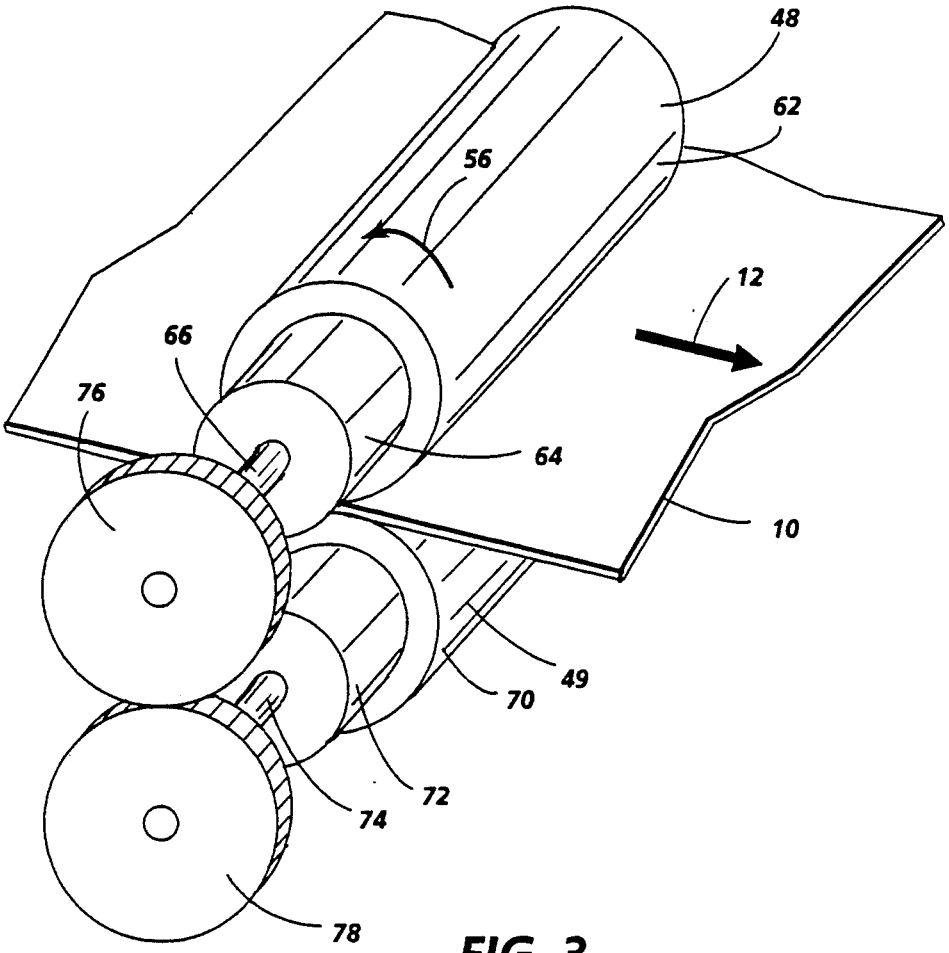
FIG. 3 is a schematic perspective view showing the coupling between the FIG. 2 cleaning rollers.

After the copy sheet is separated from the photoconductive surface of belt 10, some residual liquid developer material remains adhering thereto. This residual developer material is removed from the photoconductive surface at cleaning station F. Cleaning station F includes a cleaning roller 48 driven in the same direction as the direction of movement of belt 10, as indicated by arrow 12, to scrub the photoconductive surface clean. To assist in this action, developing liquid may be fed through pipe 50 onto the surface of cleaning roller 48. A back-up roller 49 contacts the opposite side of belt 10 and rotates in unison with roller 48 in the same direction as the direction of movement of belt 10, as indicated by arrow 12. Rollers 48 and 49 are resiliently urged into engagement with opposed sides of belt 10. Further details of rollers 48 and 49 are shown in FIGS. 2 and 3, and will be discussed hereinafter with reference thereto. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles, dispersed therein. A suitable insulating liquid carrier may be made from an aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Pat. No. 4,582,774, issued to Landa in 1986, the relevant portions thereof being incorporated into the present application.

It is believed that the foregoing description is sufficient for purposes of the present application to illustrate the general operation of an electrophotographic printing machine incorporating the features of the present invention therein.

Referring now to FIG. 2, there is shown further details of the cleaning and drive operation of rollers 48 and 49. Roller 48 is mounted rotatably and rotates in the direction of arrow 56. The tangential velocity of roller 48 is substantially equal to the velocity of belt 10. At the region of contact between belt 10 and roller 48, the tangential velocity of roller 48 is in the same direction as the direction of movement of belt 10, as indicated by arrow 12. Thus, roller 48 rotates in synchronism with the movement of belt 10. Roller 48 is mounted rotatably on a pivotable frame so as to press against belt 10 in the region opposed from roller 49. A spring 58 having one end **58*a* secured fixedly to the machine frame has the other end 58*b* thereof secured to the free end of bar 60. End 60*a* of bar 60 is mounted pivotably on the machine frame. Spring 58 resiliently urges bar 60 to pivot about end 60*a* pressing against a portion of roller 48. In this way, roller 48 is pressed against the photoconductive surface of belt 10. The other side of belt 10 presses against back-up roller 49. The photoconductive surface of belt 10 has the residual liquid developer material adhering thereto. As roller 48 rotates in the direction of arrow 56 the residual liquid developer material on the photoconductive surface of belt 10 is removed therefrom by the scrubbing action of the roller 48. Preferably, roller 48 is made from a sleeve 62 having a hard, smooth exterior circumferential surface with a low coefficient of friction mounted on a substantially rigid core 64. For example, sleeve 62 may be made from a smooth hard urethane material with core 64 being made from a suitable steel. Core 64 extends outwardly beyond sleeve 62 on opposed ends thereof. Bar 60 contacts core 64. Spring 58 pivots bar 60 to press against core 64 resiliently pressing sleeve 62 against the photoconductive surface of belt 10 with sifficient pressure to clean the residual liquid developer material therefrom. Shaft 66 extends outwardly from opposed ends of core 64 and is mounted rotatably by suitable bearings in a frame that, in turn, is mounted pivotably in the printing machine. Back-up roller 49 is coupled to cleaning roller 48 by gears (FIG. 3) to rotate in unison therewith. Back-up roller 49 is mounted rotatably on a fixed support secured to the printing machine and rotates in the direction of arrow 68. As shown in FIG. 2, back-up roller 49 presses against the back side of belt 10, i.e. the side opposed to the photoconductive surface. Preferably, roller 49 is made from a sleeve 70 having a rough exterior circumferential surface with a high coefficient of friction. Sleeve 70 is mounted on a substantially rigid core 72. Shaft 74 extends outwardly from core 72 on opposed ends thereof. Shaft 74 is mounted on suitable bearings in the printing machine to rotate relative thereto. For example, sleeve 62 may be made from a hard rubber having its exterior circumferential surface ground to roughen it to the desired coefficient of friction. The coefficient of friction of the back side of belt 10 is also relatively high. In this way, movement of belt 10, in the direction of arrow 12, frictionally drives back-up roller 49 causing it to rotate in the direction of arrow 68. As roller 49 rotates in the direction of arrow 68, it drives roller 48 through the gears coupling the rollers to one another. Roller 48 rotates, in the direction of arrow 56, in synchronism with the movement of belt 10 in the direction of arrow 12. One skilled in the art will appreciate that the frictional force is proportional to the normal force exerted by spring 58 and the coefficient of friction between sleeve 70 of roller 49 and the back side of belt 10. Inasmuch as motor 19 drives belt 10 to move in the direction of arrow 12, roller 49 is frictionally rotated by this movement and, in turn, drives roller 48 to rotate in the direction of arrow 56 to clean the residual liquid developer material from the photoconductive surface of belt 10**.

One skilled in the art will appreciate tht although belt 10 has been illustrated as being driven by a motor and, it, in turn, frictionally rotates back-up roller 49, back-up roller 49 may be rotated by a suitable motor it, in turn, will frictionally move belt 10 so that belt 10 need not be directly driven. Still another alternative is to use a suitable motor to rotate roller 48, which, in turn, through the gear drive, rotates roller 49. Rotation of roller 49 frictionally moves belt 10 in the direction of arrow 12. In any event, it is clear that only one drive system is required for driving both the cleaning roller and the photoconductive belt.

Turning now to FIG. 3, there is shown the gear drive coupling roller 48 with roller 49. Gear 76 is mounted on shaft 66 beyond one end of belt 10 so as to be spaced therefrom. Similarly, gear 78 is mounted on shaft 74 and meshes with gear 76. Gears 76 and 78 have the same number of teeth. In this way, as motor 19 (FIG. 1) rotates roller 14 (FIG. 1) to move belt 10 linearly in the direction of arrow 12, roller 49 is frictionally rotated. As roller 49 rotates, gear 78 rotates in unison therewith driving gear 76. Rotation of gear 76 rotates roller 48 in unison therewith to remove the extraneous residual liquid developer material from the photoconductive surface of belt 10. In the event roller 48 is rotated directly by a motor coupled thereto and belt 10 is not driven directly by a motor, gear 76 rotates gear 78 causing roller 49 to rotate in the direction of arrow 68. As roller 49 rotates in the direction of arrow 68, it frictionally moves belt 10 in the direction of arrow 12. Alternatively, in the event roller 49 is rotated by a motor coupled directly thereto and belt 10 is not driven by a motor coupled directly thereto, rotation of roller 49 frictionally moves belt 10 in the direction of arrow 12. In addition, as roller 49 rotates, gear 78 meshing with gear 76 rotates roller 48 at the same angular velocity. Thus, only one drive system is required to drive both the cleaning roller and the photoconductive belt.

In recapitulation, it is clear that the present invention frictionally couples the cleaning system to the photoconductive belt so that only on drive system is required to rotate the cleaning roller as the photoconductive belt is moved linearly. As the cleaning roller rotates, it removes residual liquid developer material from the photoconductive surface of the belt. Of course, the present invention is not limited to a belt and a photoconductive drum may be used in lieu of a belt in the same type of a relationship. Under these circumstances, the back-up roller is positioned interiorly of the drum engaging the interior surface thereof while the cleaning roller engages the exterior surface for removing the residual liquid developer material therefrom.

It is, therefore, evident that there has been provided in accordance with the present invention, an apparatus that fully satisfies the aims and advantages heretofore mentioned. While this invention has been described in conjunction with a preferred embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed:

1. An electrophotographic printing machine of the type in which a photoconductive belt has extraneous liquid developer material thereon, wherein the improvement includes:

a first roller for cleaning a substantial portion of the extraneous liquid material from the photoconductive belt;

a second roller rotatively coupled to said first roller with the photoconductive belt being interposed between said first roller and said second roller.

means for pressing said first roller and said second roller into contact with the photoconductive belt; and means for moving either the photoconductive belt or said second roller with movement of one frictionally moving the other so that said first roller and the belt move with the extraneous liquid material being removed from the belt with the tangential velocity of said first roller being substantially equal to the velocity of the photoconductive belt.

2. A printing machine according to claim 1, wherein said pressing means resiliently urges said first roller into contact with the photoconductive belt.

3. A printing machine according to claim 2, wherein said second roller includes an exterior circumferential surface having a high coefficient of friction.

4. A printing machine according to claim 3, wherein said first roller includes an exterior circumferential surface having a low coefficient of friction.

5. A printing machine according to claim 4, wherein said first roller contacts the surface of the photoconductive belt having the residual liquid developer material thereon.

6. A printing machine according to claim 5, wherein said second roller contacts the surface of said photoconductive member opposed from the surface thereof having the residual liquid deveoloper material thereon.

* * * * *